US007159966B2

(12) United States Patent
Taira

(10) Patent No.: US 7,159,966 B2
(45) Date of Patent: Jan. 9, 2007

(54) INK-JET HEAD CAPABLE OF SUPPRESSING A DEFECTIVE BONDING

(75) Inventor: Hiroshi Taira, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/668,292

(22) Filed: Sep. 24, 2003

(65) Prior Publication Data

US 2004/0114004 A1 Jun. 17, 2004

(30) Foreign Application Priority Data

Sep. 25, 2002 (JP) ..... 2002-278765

(51) Int. Cl.
*B41J 2/14* (2006.01)

(52) U.S. Cl. ..... 347/47; 347/94; 347/71

(58) Field of Classification Search ..... 347/45, 347/47, 63, 65, 68–72, 93, 94, 20, 67
See application file for complete search history.

(56) References Cited

U.S. PATENT DOCUMENTS 4,611,219 A * 9/1986 Sugitani et al. ..... 347/68
5,712,669 A * 1/1998 Swanson et al. ..... 347/49

FOREIGN PATENT DOCUMENTS

| | | |
|---|---|---|
| JP | A 6-218919 | 8/1994 |
| JP | A 8-1927 | 1/1996 |
| JP | A 9-262980 | 10/1997 |
| JP | B2 2992756 | 10/1999 |
| JP | A 2001-58402 | 3/2001 |
| JP | A-2001-205804 | 7/2001 |

* cited by examiner

*Primary Examiner*—Juanita D. Stephens
(74) *Attorney, Agent, or Firm*—Oliff & Berridge, PLC

(57) ABSTRACT

An ink-jet head comprises a passage unit formed with a plurality of nozzles for ejecting ink, a reservoir unit bonded to the passage unit, and actuator units for applying an ejection energy to ink in the passage unit. The reservoir unit is formed therein with an ink reservoir extending along a bonding surface between the reservoir unit and the passage unit. The ink reservoir reserves ink supplied from an ink tank and supplies the reserved ink to the passage unit. The ink reservoir is formed therein with a plurality of pillars supporting upper and lower walls of the ink reservoir.

10 Claims, 14 Drawing Sheets

INK-JET HEAD CAPABLE OF SUPPRESSING A DEFECTIVE BONDING

BACKGROUND OF THE INVENTION

1. Field of the Invention

The present invention relates to an ink-jet head that ejects ink to print a desired image on a recording medium.

2. Description of Related Art

Japanese Patent No. 2992756 discloses an ink-jet head in which an ink chamber, referred to as a reservoir, communicating with a plurality of supply paths each formed with a pressure chamber and a nozzle is provided within a substrate. In this ink-jet head, the substrate and an ink tank separately disposed at the outside of the substrate are connected with each other via a connecting passage so that ink is supplied into the reservoir. The ink supplied to the reservoir passes through the respective supply paths and is ejected from each nozzle. Protrusions for branching ink are formed in the reservoir The protrusions prevent air bubbles from being stagnant in the reservoir.

Japanese Patent Laid-Open No. 9-262980 discloses an ink-jet head in which ink is supplied from an ink chamber, referred to as a manifold channel, to a liquid chamber facing a piezoelectric element, and then ejected from a nozzle opening. In this ink-jet head, ribs are disposed in the manifold channel in order to prevent generation of air bubbles in the manifold channel to realize that ink has a uniform passage resistance until reaching each liquid chamber.

Japanese Patent Laid-Open No. 6-218919 discloses an ink-jet head in which ink supplied from an ink supply hole is distributed from an ink chamber, referred to as a reservoir, to a plurality of passages each extending to a nozzle. In this ink-jet head, a substrate constituting the passages and the reservoir, and a second substrate formed with protrusions are laminated with each other. Since the protrusions having a high dimensional accuracy formed on the second substrate are inserted into the passages in the substrate, a stable dimensional accuracy of the passages can be obtained.

None of the above-mentioned ink-jet heads are constructed by bonding two units, by applying pressure thereto, each formed therein with a ink passage such that their ink passages may connect with each other. These references do not disclose that, in the ink-jet heads, a reduction of the pressure and irregularities in application of pressure during bonding two units by applying pressure thereto cause a defective bonding between the units.

SUMMARY OF THE INVENTION

A primary object of the present invention is to provide an ink-jet head capable of suppressing a defective bonding between two units each formed with an ink passage.

According to one aspect, an ink-jet head of the present invention comprises a passage unit formed with a plurality of nozzles for ejecting ink, and a reservoir unit bonded to the passage unit by being pressurized. The passage unit includes a plurality of individual ink passages each leading via a pressure chamber to the nozzle. The reservoir unit includes an ink reservoir extending along a bonding surface between the reservoir unit and the passage unit to reserve ink supplied from an ink tank and supply the reserved ink to the passage unit. The ink reservoir is formed therein with one or more pillars supporting two opposite walls of the ink reservoir both extending perpendicularly to a direction across the bonding surface between the reservoir unit and the passage unit.

When a reservoir unit and a passage unit are bonded to each other by applying pressure thereto, absence of pillars reduces a pressure applied to the reservoir unit due to an existence of an ink reservoir, and the reduced pressure is then applied to the passage unit. In contrast, in case that the pillars are formed in the ink reservoir as in the present invention, the pillars contribute to transfer of a pressure, and therefore, the pressure applied to the reservoir unit is transferred to the passage unit without being largely reduced down and with irregularities being hardly caused. Thus, the reservoir unit and the passage unit can be bonded to each other with a large pressure. This can prevent an ink leakage from a bonding portion, caused by a defective bonding between the reservoir unit and the passage unit.

According to another aspect, an ink-jet head of the present invention comprises a first passage unit formed with a plurality of nozzles for ejecting ink, and a second passage unit bonded to the first passage unit by being pressurized. The first passage unit includes a plurality of individual ink passages each leading via a pressure chamber to each of the nozzles. The second passage unit includes a common ink passage through which ink to be supplied to the individual ink passages passes. The common ink passage is formed therein with one or more pillars supporting two opposite walls of the common ink passage both extending perpendicularly to a direction across a bonding surface between the second passage unit and the first passage unit.

With this construction, since the pillars contribute to transfer of a pressure in bonding the two passage units by applying pressure thereto, the pressure applied to the second passage unit is transferred to the first passage unit without being largely reduced down and with irregularities being hardly caused. Thus, the first passage unit and the second passage unit can be bonded to each other with a large pressure. This can prevent an ink leakage from a bonding portion, caused by a defective bonding between the first passage unit and the second passage unit.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
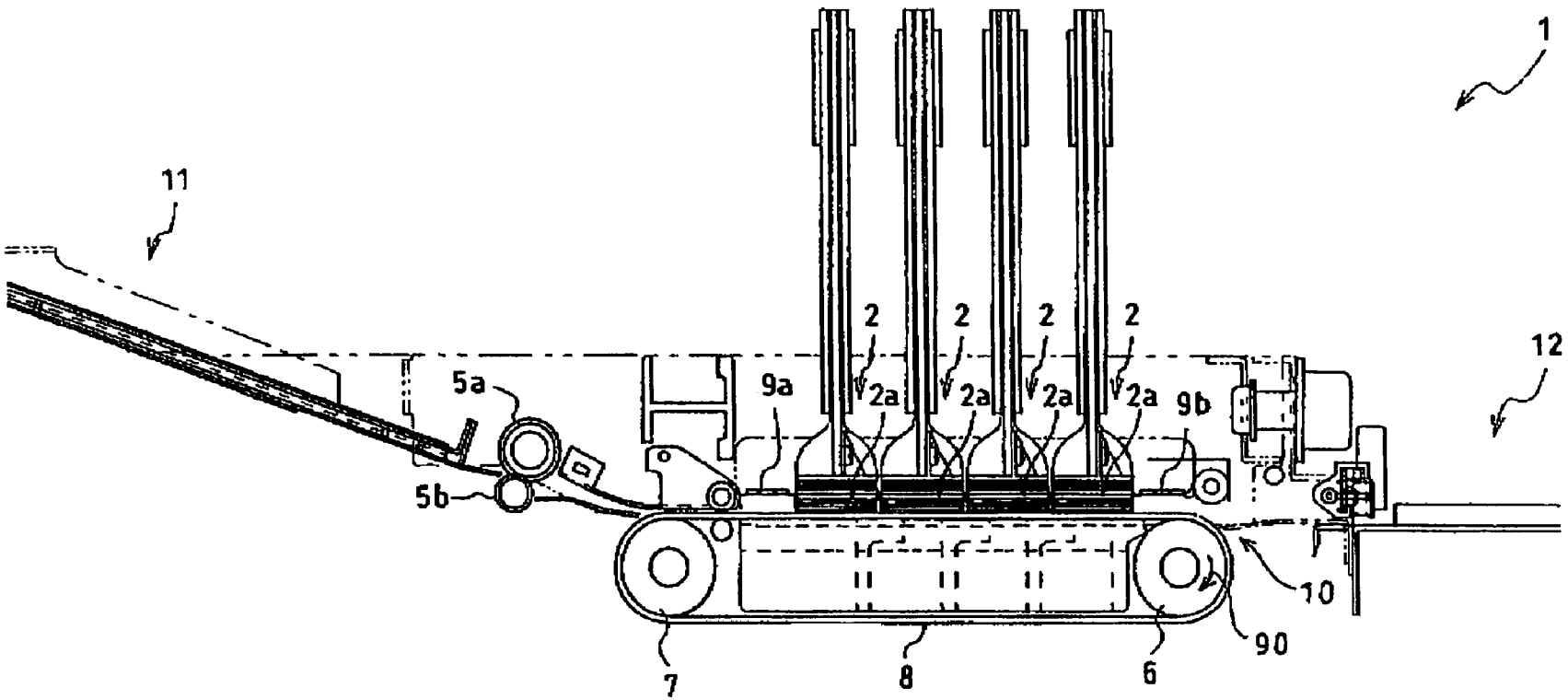
FIG. 1 schematically illustrates an example of a printer including ink-jet heads according to a first embodiment of the present invention.

A first embodiment of the present invention will hereinafter be described. FIG. 1 illustrates an ink-jet printer 1 including ink-jet heads according to the embodiment. The ink-jet printer 1 is a color ink-jet printer having four ink-jet heads 2. The ink-jet printer I has a paper feed unit 11 (on left side in FIG. 1) and a paper discharge unit 12 (on right side in FIG. 1). Within the ink-jet printer 1, a paper conveyance path is formed extending from the paper feed unit 11 to the paper discharge unit 12.

A pair of paper feed rollers 5*a* and 5*b* are disposed immediately downstream of the paper feed unit 11 for putting forward a paper as a medium from left to right in FIG. 1. In a middle of the paper conveyance path, two belt rollers 6 and 7 and a looped conveyor belt 8 are provided. The conveyor belt 8 is wrapped around both of the belt rollers 6 and 7 as to be stretched between them.

The conveyor belt 8 has a two-layered structure made up of a polyester base body impregnated with urethane and a silicone rubber. The silicone rubber is disposed at an outer portion of the conveyor belt 8 to form a conveyor face. A paper fed through the pair of paper feed rollers 5*a* and 5*b* is kept on the conveyor face of the conveyor belt 8 by adhesion. In this state, the paper is conveyed downstream, i.e., rightward in FIG. 1, by driving one belt roller 6 to rotate clockwise (indicated by an arrow 90) in FIG. 1.

Pressing members 9*a* and 9*b* are respectively provided at positions for feeding paper onto the conveyor belt 8 and for discharging the paper from the conveyor belt 8, respectively. Either of the pressing members 9*a* and 9*b* is for pressing a paper onto the conveyor face of the conveyor belt 8 so as to prevent the paper from separating from the conveyor face.

A peeling device 10 is provided in the paper conveyance path immediately downstream of the conveyor belt 8 (on right side in FIG. 1). The peeling device 10 peels off the paper, which has been kept on the conveyor face of the conveyor belt 8 by adhesion, from the conveyor face so that the paper can be transferred toward the rightward paper discharge unit 12.

Figure 2:
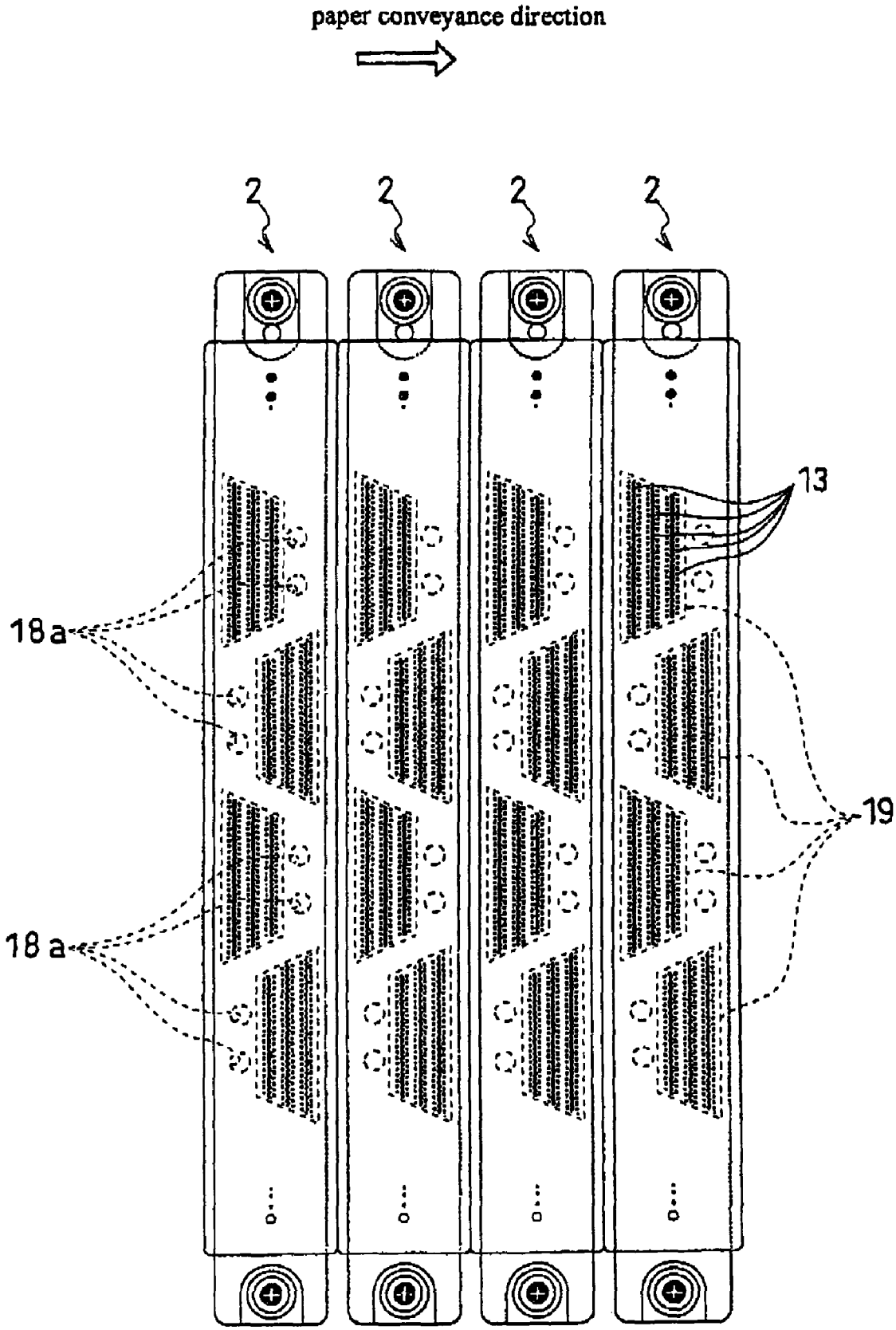
FIG. 2 is a bottom view of the four ink-jet heads illustrated in FIG. 1.

Each of the four ink-jet heads 2 has, at its lower end, a head main body 2*a*. The four head main bodies 2*a* eject ink of magenta, yellow, cyan, and black, respectively. As illustrated in FIG. 2, each head main body 2*a* has a rectangular section. The head main bodies 2*a* are arranged and fixed close to each other with a longitudinal axis of each head main body 2*a* being perpendicular to the paper conveyance direction (a direction perpendicular to FIG. 1). That is, this printer 1 is a line type. A bottom of each of the four head main bodies 2*a* faces the paper conveyance path. A large number of small-diameter ink ejection ports, i.e., nozzles 13 are formed in the bottom of each head main body 2*a*. In each of the heads 2, the nozzles 13 are formed concentratedly within four trapezoidal regions. Each of the trapezoidal regions has almost the same shape as that of an actuator unit 19 described below.

The head main bodies 2*a* are disposed such that a narrow clearance is formed between a bottom face of each head main body 2*a* and the conveyor face of the conveyor belt 8. The paper conveyance path is formed within the clearance. Thus, while a paper, which is being conveyed by the conveyor belt 8, passes immediately below the four head main bodies 2*a* in order, the respective color inks are ejected through the corresponding nozzles toward an upper face, i.e., a print face of the paper to form a desired color image on the paper.

Figure 3:
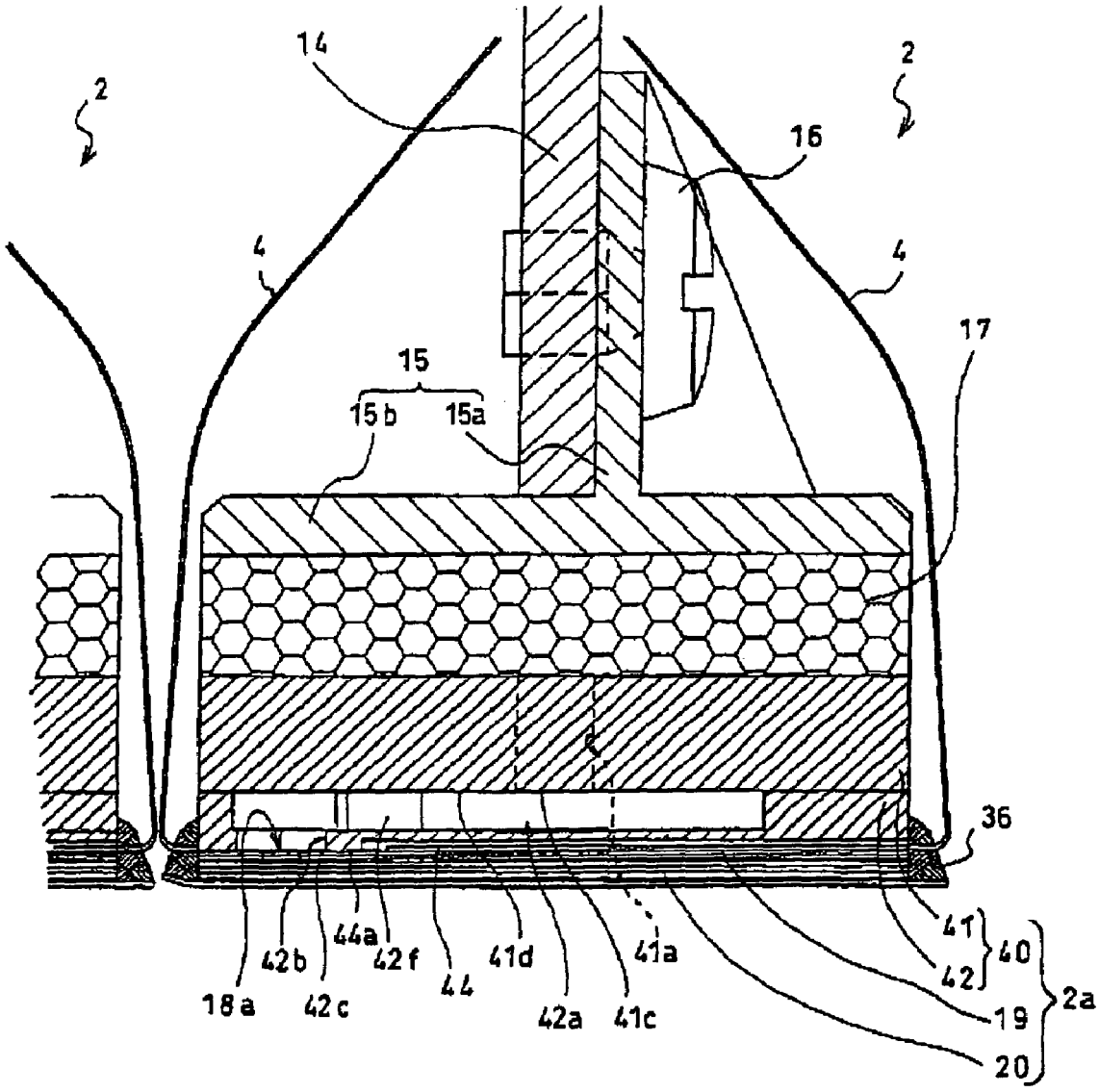
FIG. 3 is an enlarged longitudinal section of a part of the ink-jet head according to the first embodiment of the present invention.

Referring to FIG. 3, the ink-jet head 2 includes the head main body 2*a*, a holder 15 attached to the head main body 2*a* with a spacer 17 between them, and a support 14 for supporting the holder 15. The support 14 is fixed to a chassis (not illustrated) in the printer 1. The holder 15 has an inversed-T shape in a side view, made up of a perpendicular portion 15*a* and a horizontal portion 15*b*. The perpendicular portion 15*a* is attached to the support 14 with a screw 16, and the head main body 2*a* is fixed to a bottom face of the horizontal portion 15*b* with a spacer 17 positioned therebetween.

The head main body 2*a* includes a passage unit 20 with a large number of nozzles 13 formed on a bottom face thereof, four actuator units 19 (see FIGS. 4 and 5) to apply ejection energy to ink in the passage unit 20, and a reservoir unit 40 for supplying ink to the passage unit 20. Each of the passage unit 20 and the actuator unit 19 has a layered structure laminated with a plurality of thin plates. The reservoir unit 40 made of, similarly to the passage unit 20, a metallic material such as stainless steel has almost the same planar shape as that of the passage unit 20. Both of the actuator units 19 and the reservoir unit 40 are bonded to an upper face of the passage unit 20.

Figure 4:
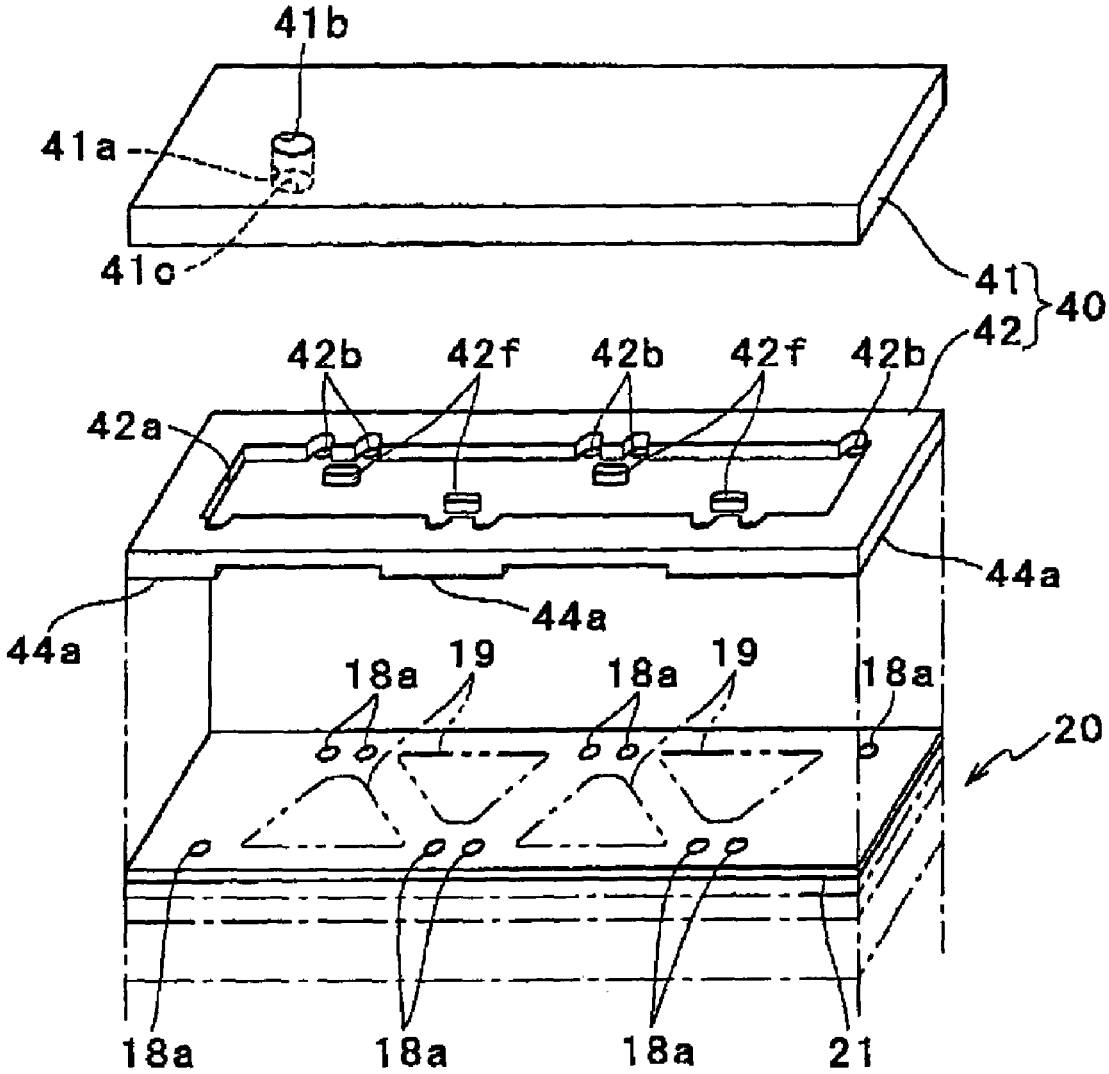
FIG. 4 is an exploded perspective view of a head main body illustrated in FIG. 3.

FIG. 4 is an exploded perspective view of the head main body 2*a* without the actuator units 19. Referring to FIGS. 3 and 4, the reservoir unit 40 is formed by laminating two plates, i.e., an upper plate 41 and a lower plate 42. A concavity with a periphery thereof being entirely enclosed is formed, by half etching, on an upper face of the lower plate 42. The upper plate 41 having a planar lower face covers the concavity so as to define an ink reservoir 42*a*. The ink reservoir 42*a* is a nearly rectangular parallelepiped hollow region for reserving ink to be supplied to the passage unit 20. The ink reservoir 42*a* has a nearly rectangular planar shape extending in a longitudinal direction of the head main body 2*a* (see FIG. 12). In the ink reservoir 42*a*, formed are four pillars 42*f* connecting upper and lower walls of the ink reservoir 42*a*. The pillars 42*f* will be described later in detail.

Figure 5:
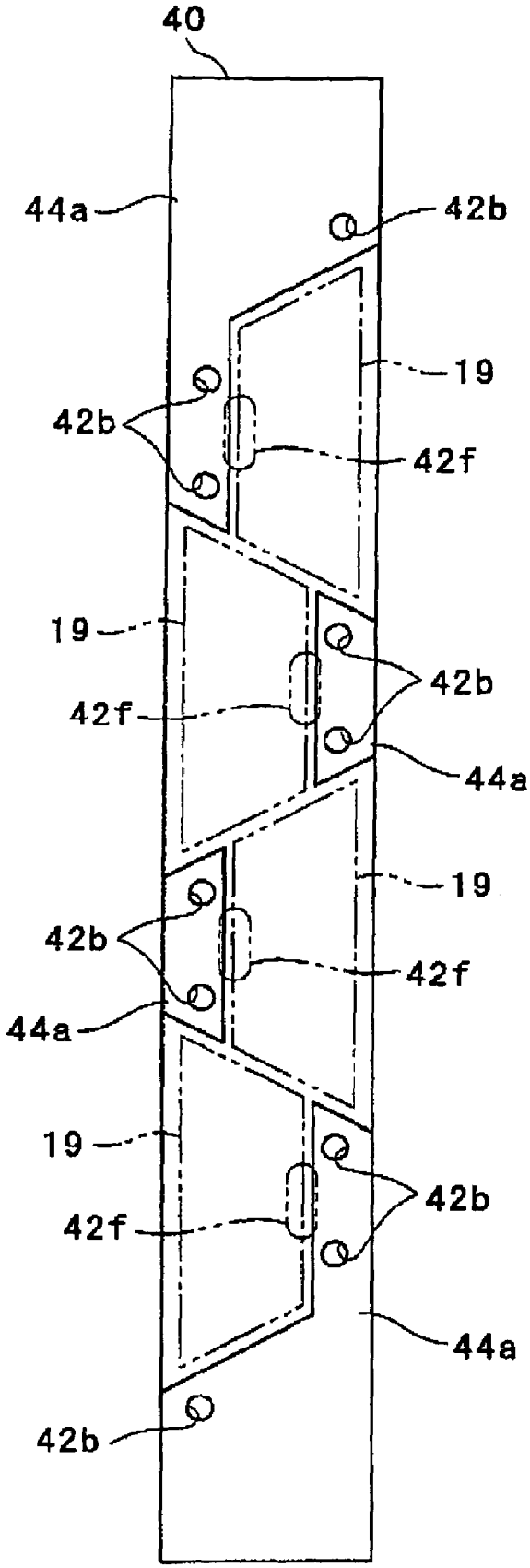
FIG. 5 is a bottom view of a reservoir unit included in the head main body illustrated in FIG. 3.

Referring to FIG. 5 illustrating a bottom view of the reservoir unit 40, on a bottom face 44 of the reservoir unit 40 constituting a bonding surface to the passage unit 20, four protruding areas 44*a* protruding downward from their surroundings are formed, by half etching, in a zigzag manner in a longitudinal direction of the reservoir unit 40. The reservoir unit 40 is in contact with the passage unit 20 only at the protruding areas 44*a*. Accordingly, recessed areas of the bottom face 44 of the reservoir unit 40 other than the protruding areas 44*a* are distant from the passage unit 20. The four actuator units 19 are arranged, in a zigzag manner, in areas of the upper face of the passage unit 20 facing the recessed areas.

Referring again to FIG. 3, a flexible printed circuit (FPC) 4 as a power supply member for feeding drive signals to the actuator unit 19 is bonded to an upper face of the actuator unit 19. Each FPC 4 is drawn out to left or right and bent upward along the head main body 2*a*.

A silicon-base adhesive 36 is put on a side face of the head main body 2*a* corresponding to an opening for drawing out the FPC 4. The adhesive 36 serves to prevent an inflow of ink, etc., from a gap between the FPC 4 and the reservoir unit 40.

An ink flow within the head main body 2*a* will here be described. Referring to FIGS. 3 and 4, a supply passage 41*a* is formed in the upper plate 41 of the reservoir unit 40. The supply passage 41*a* is formed near one end of the upper plate 41 in the longitudinal direction thereof, and penetrates the upper plate 41 in a thickness direction. The supply passage 41*a* connects a supply port 41*b* formed on a surface of the reservoir unit 40 with an inlet port 41*c* of the ink reservoir 42*a*. Ink supplied from a non-illustrated ink tank to the head main body 2*a* flows into the supply passage 41*a* from the supply port 41*b*, and then reach the ink reservoir 42*a*. In the present embodiment, since the inlet port 41*c* is formed near one end of the ink reservoir 42*a* in the longitudinal direction thereof, the ink having reached to the ink reservoir 42*a* from the inlet port 41*c* flows in the ink reservoir 42*a* toward the other end thereof in the longitudinal direction.

Referring to FIGS. 3 to 5, ten connecting passages 42*b* connecting the ink reservoir 42*a* with the bottom face of the reservoir unit 40 are provided in the lower plate 42 of the reservoir unit 40. Connecting ports 42*c* are openings of the connecting passages 42*b*, facing the passage unit 20, and formed at positions to be connected with connecting ports 18*a* formed on the upper face of the passage unit 20. The ink in the ink reservoir 42*a* is supplied to the passage unit 20 through the ten connecting passage 42*b*. The ink supplied to the passage unit 20 is ejected from the nozzles 13. The supply passage 41*a*, the ink reservoir 42*a*, and the connecting passages 42*b*, both in the reservoir unit 40, constitute a common ink passage through which ink to be supplied to the passage unit 20 passes.

Figure 6:
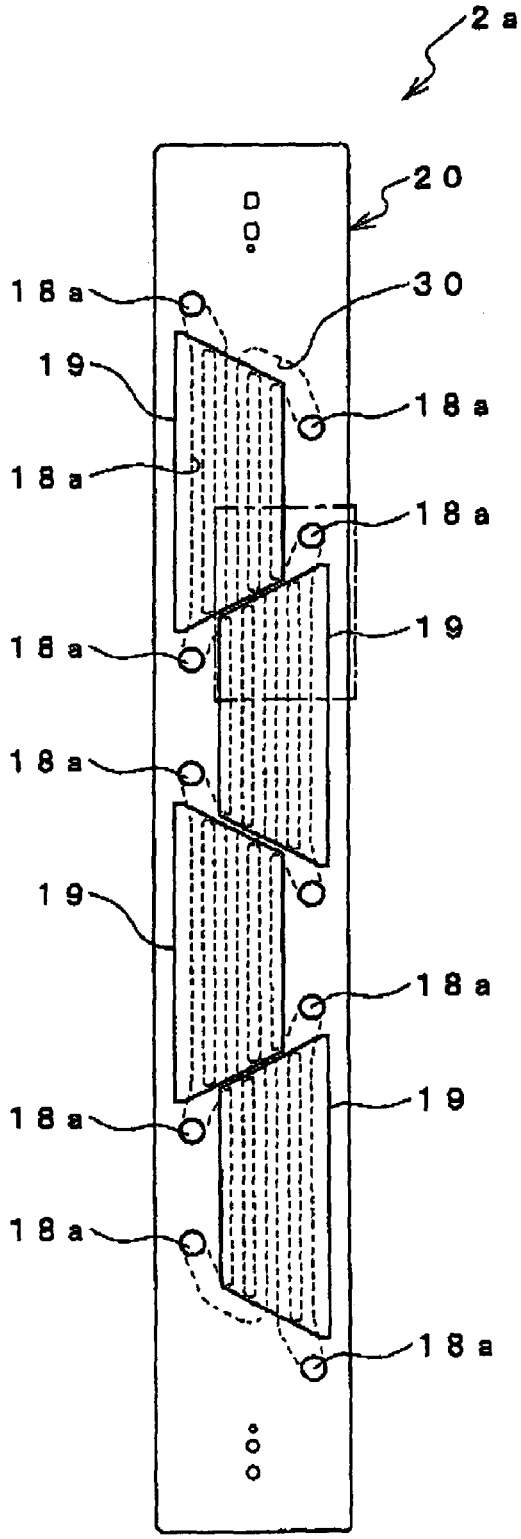
FIG. 6 is a plan view of the head main body illustrated in FIG. 3.

FIG. 6 is a plan view of the head main body 2*a* without the reservoir unit 40. As illustrated in FIG. 6, the passage unit 20 has a rectangular shape in a plan view extending in one direction (the main scanning direction). In FIG. 6, manifold channels 30 as common ink chambers formed in the passage unit 20 are illustrated with broken lines. Ink is supplied from the ink reservoir 42*a* in the 5 reservoir unit 40 to the manifold channels 30 through the ten connecting ports 18*a* formed on the upper face of the passage unit 20. Each of the manifold channels 30 branches into a plurality of sub-manifold channels 30*a* extending in parallel with a longitudinal direction of the passage unit 20. The ten connecting ports 18*a* are arranged in two lines, with each line including five connecting ports 18*a*, along the longitudinal direction of the head main body 2*a*.

The four actuator units 19 each having a trapezoidal shape in a plan view arranged in two lines in a zigzag manner so as to keep away from the connecting ports lea are bonded onto the upper face of the passage unit 20. Each actuator unit 19 is disposed such that its parallel opposed sides (upper and lower sides) may extend along the longitudinal direction of the passage unit 20. Oblique sides of each neighboring actuator units 19 partially overlap each other in a lateral direction of the passage unit 20.

A bottom face of the passage unit 20 corresponding to a bonded region of each actuator unit 19 is made into an ink ejection region where a large number of nozzles 13 are arranged in a matrix. A group of pressure chambers in which a large number of pressure chambers 34 (see FIG. 7) are arranged in a matrix is formed on a surface of the passage unit 20 facing to each actuator unit 19.

Figure 7:
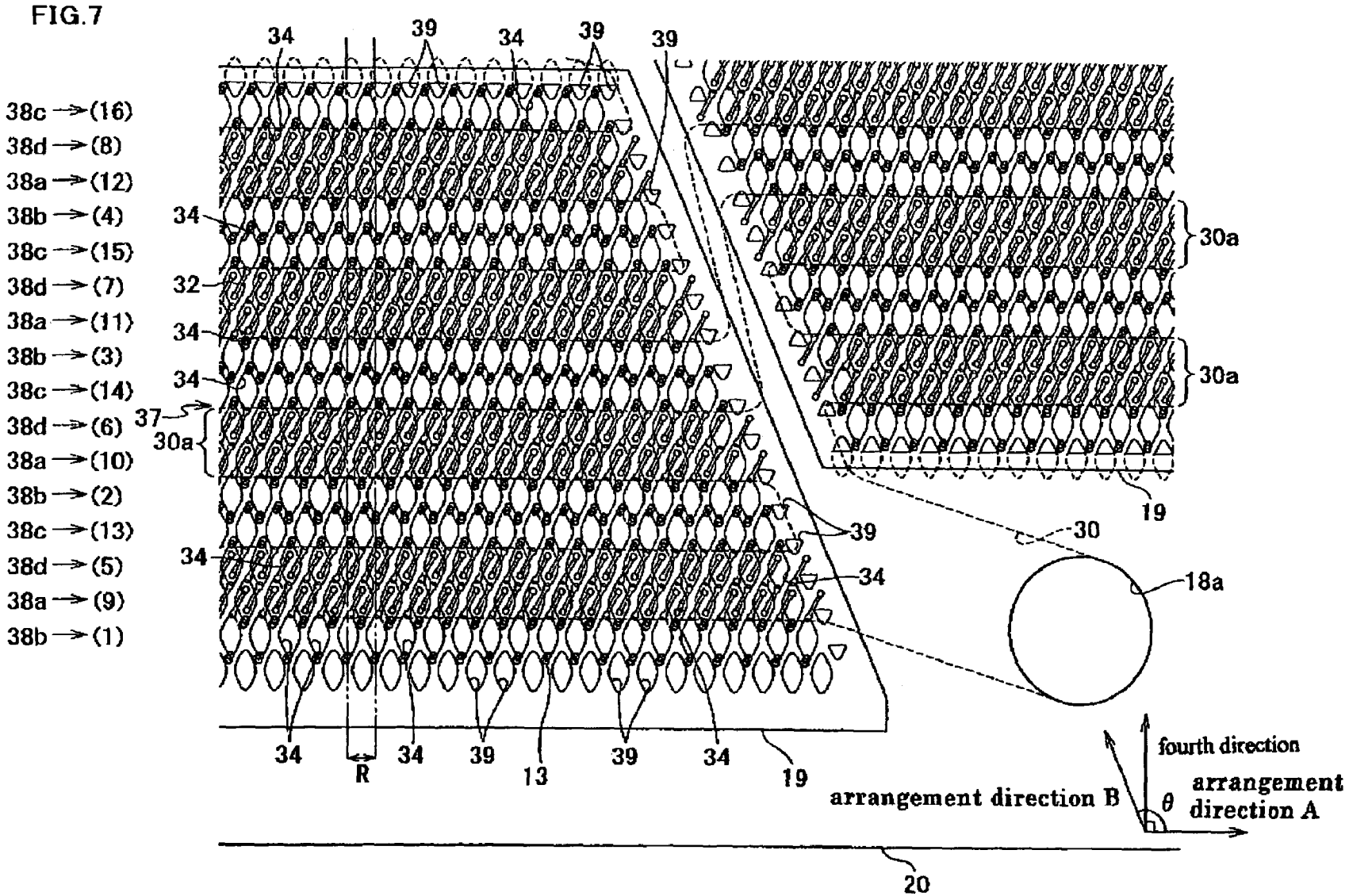
FIG. 7 is an enlarged view of a region enclosed by an alternate long and short dash line in FIG. 6.
Figure 8:
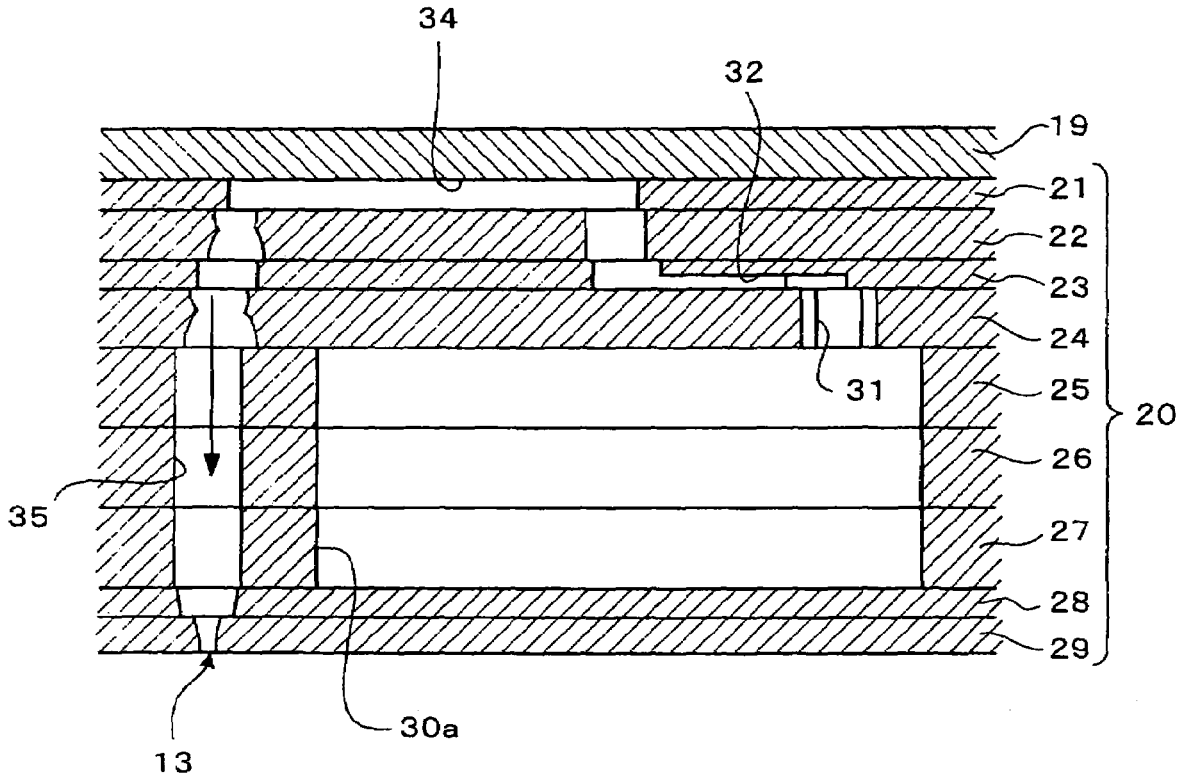
FIG. 8 is a partial sectional view corresponding to a pressure chamber in the head main body illustrated in FIG. 6.

FIG. 7 is an enlarged view of a region enclosed by an alternate long and short dash line in FIG. 6. As illustrated in FIG. 7, in areas within the passage unit 20 corresponding to the actuator unit 19, four sub-manifold channels 30*a* extend in parallel with the longitudinal direction of the passage unit 20. Many individual ink passages, extending from an outlet port of each sub-manifold channel 30*a* to the nozzle 13, are connected with each sub-manifold channel 30*a*. FIG. 8 is a sectional view of the individual ink passage. As illustrated in FIG. 8, each nozzle 13 communicates with a sub-manifold channel 30*a* through a pressure chamber 34 and an aperture, i.e., a restriction, 32. Thus, within the head main body 2*a* formed are individual ink passages 35 each corresponding to a pressure chamber 34 and each extending from an outlet port of a sub-manifold channel 30*a* to a nozzle 13 through an aperture 32 and a pressure chamber 34.

Referring to FIG. 8, the head main body 2*a*, except for the reservoir unit 40, has a layered structure laminated with ten sheet materials in total, i.e., from the top, an actuator unit 19, a cavity plate 21, a base plate 22, an aperture plate 23, a supply plate 24, manifold plates 25, 26, and 27, a cover plate 28, and a nozzle plate 29, among which nine plates other than the actuator unit 19 constitute the passage unit 20.

As described later in detail, the actuator unit 19 is laminated with four piezoelectric sheets 51 to 54 (see FIG. 10) and is provided with electrodes, so that only an uppermost layer thereof includes portions to be active only when an electric field is applied (hereinafter, simply referred to as "layer including active layers (active portions)"), and remaining three layers are inactive. The cavity plate 21 is made of metal, in which a large number of substantially rhombic openings each constituting a cavity of each pressure chamber 34 are formed within a range of the cavity plate 21 attached to the actuator unit 19. The base plate 22, which is also made of metal, includes a communication hole formed between each pressure chamber 34 of the cavity plate 21 and the corresponding aperture 32, and a communication hole formed between the pressure chamber 34 and the corresponding nozzle 13.

The aperture plate 23 is made of metal, in which, in addition to holes to be apertures 32, communication holes are formed for connecting each pressure chamber 34 of the cavity plate 21 with a corresponding nozzle 13. The supply plate 24 is made of metal, in which communication holes 31 between each aperture 32 and a corresponding sub-manifold channel 30*a* and communication holes for connecting each pressure chamber 34 of the cavity plate 21 with a corresponding nozzle 13 are formed. Each of the manifold plates 25, 26, and 27 is made of metal, in which, in addition to a sub-manifold channel 30*a*, communication holes are formed for connecting each pressure chamber 34 of the cavity plate 21 with a corresponding nozzle 13. The cover plate 28 is made of metal, in which communication holes are formed for connecting each pressure chamber 34 of the cavity plate 21 with a corresponding nozzle 13. The nozzle plate 29 is made of metal, in which nozzles 13 are formed for respective pressure chambers 34 of the cavity plate 21.

These ten sheets 19, 21 to 29 are positioned in layers with each other to form such an individual ink passage 35 as illustrated in FIG. 8. The individual ink passage 35 first extends upward from the sub-manifold channel 30*a*, then extends horizontally in the aperture 32, then further extends upward, then again extends horizontally in the pressure chamber 34, then extends obliquely downward in a certain length to get apart from the aperture 32, and then extends vertically downward toward the nozzle 13.

Referring to FIG. 8, the pressure chambers 34 and the apertures 32 are disposed at different levels from one another. Therefore, as shown in FIG. 7, in an area of the passage unit 20 corresponding to an actuator unit 19, an aperture 32 communicating with one pressure chamber 34 can be disposed at the same position in plan view as a position of another pressure chamber 34 neighboring that pressure chamber 34 communicating with the aperture 32. As a result, because pressure chambers 34 can be arranged close to each other at a high density, high resolution image printing can be achieved with an ink-jet head 1 having a relatively small occupation area.

Referring again to FIG. 7, a group of pressure chambers 37 constituted by a large number of pressure chambers 34 is formed within a range attached to the actuator unit 19. The group of pressure chambers 37 has a trapezoidal shape of substantially the same size as the range attached to the actuator unit 19. The group of pressure chambers 37 is formed corresponding to each one of actuator units 19.

As shown in FIG. 7, each pressure chamber 34 belonging to the group of pressure chambers 37 communicates with a nozzle 13 at one end of a longer diagonal thereof, and communicates through an aperture 32 with a sub-manifold channel 30*a* at the other end of the longer diagonal thereof. As described later, on the upper face of each actuator unit 19, individual electrodes 56 (see FIGS. 9 and 10) having a nearly rhombic shape in a plan view somewhat smaller than that of the pressure chamber 34 are arranged in a matrix so as to correspond to the respective pressure chambers 34. In FIG. 7, to facilitate understanding of the drawings, nozzles 13, pressure chambers 34, and apertures 32, etc., are illustrated with solid lines though they should be illustrated with broken lines because they are in the passage unit 20.

Pressure chambers 34 are arranged adjacent to each other in a matrix in two directions, i.e., an arrangement direction A (first direction) and an arrangement direction B (second direction). The arrangement direction A is a longitudinal direction of the ink-jet head 1, i.e., an extending direction of the passage unit 20 parallel with a shorter diagonal of a pressure chamber 34. The arrangement direction B is along an oblique side of a pressure chamber 34, which makes an obtuse angle θ, theta, with the arrangement direction A. Both acute portions of each pressure chamber 34 are located between other two neighboring pressure chambers.

The pressure chambers 34 arranged adjacent to each other in a matrix in two directions of the arrangement direction A and the arrangement direction B are spaced from each other along the arrangement direction A by a distance corresponding to 37.5 dpi. Sixteen pressure chambers 34 are arranged in the arrangement direction B in one actuator unit 19. Each group of pressure chambers 37 is enclosed with many dummy pressure chambers 39 making no contribution to ink ejection.

A large number of pressure chambers 34 arranged in a matrix constitute pressure chamber rows along the arrangement direction A in FIG. 7. When viewed perpendicularly to FIG. 7 (in third direction), the pressure chamber rows are classified into first, second, third, and forth pressure chamber rows 38*a*, 38*b*, 38*c*, and 38*d*, respectively, in accordance with their relative positions to the sub-manifold channel 30*a*. Each of these first to forth pressure chamber rows 38*a* to 38*d* are periodically disposed four times in order of, from an upper side toward a lower side of the actuator unit 19, 38*c*, 38*d*, 38*a*, 38*b*, 38*c*, 38*d*, . . . 38*b* in series.

In pressure chambers 34 constituting the first pressure chamber rows 38*a* and pressure chambers 34 constituting the second pressure chamber rows 38*b*, nozzles 13 are deviated downward in FIG. 7 with respect to a direction perpendicular to the arrangement direction A (forth direction), when viewed from the third direction. Each nozzle 13 faces to a vicinity of a lower end of a corresponding pressure chamber 34. In pressure chambers 34 constituting the third pressure chamber rows 38*c* and pressure chambers 34 constituting the forth pressure chamber rows 38*d*, on the other hand, nozzles 13 are deviated upward in FIG. 7 with respect to the forth direction. Each nozzle 13 faces to a vicinity of an upper end of a corresponding pressure chamber 34. In the first and forth pressure chamber rows 38*a* and 38*d*, no less than half area of each pressure chamber 34 overlaps with the sub-manifold channel 30*a*, when viewed from the third direction. In the second and third pressure chamber rows 38*b* and 38*c*, an almost whole area of the pressure chambers 34 does not overlap with the sub-manifold channel 30*a*, when viewed from the third direction. Therefore, in a pressure chamber 34 belonging to any pressure chamber row, a nozzle 13 communicating with the pressure chamber 34 can avoid overlapping with the sub-manifold channel 30*a*, while a width of the sub-manifold channel 30*a* can be made as large as possible to smoothly supply ink to each pressure chamber 34.

Next, a construction of the actuator unit 19 will be described. A large number of individual electrodes 56 having the same pattern as that of the pressure chamber 34 are arranged in a matrix on the actuator unit 19. Each individual electrode 56 is arranged at a position corresponding to each pressure chamber 34 in a plan view.

Figure 9:
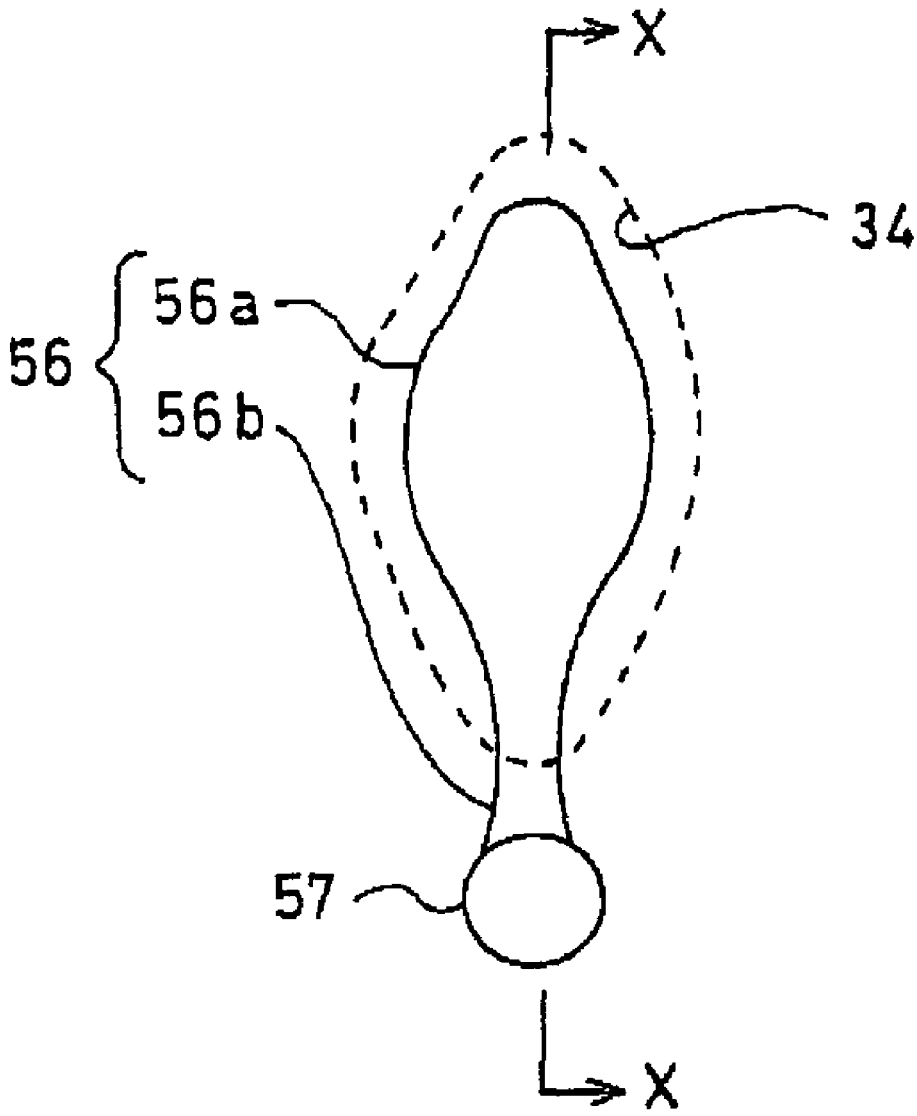
FIG. 9 is a plan view of an individual electrode formed on an actuator unit illustrated in FIG. 6.

FIG. 9 is a plan view of an individual electrode 56. Referring to FIG. 9, the individual electrode 56 is composed of the main electrode region 56*a* arranged at a position corresponding to the pressure chamber 34 and included in the pressure chamber 34 in a plan view, and an auxiliary electrode region 56*b* formed continuously from the main electrode region 56*a* and arranged at a position corresponding to an outside of the pressure chamber 34.

Figure 10:
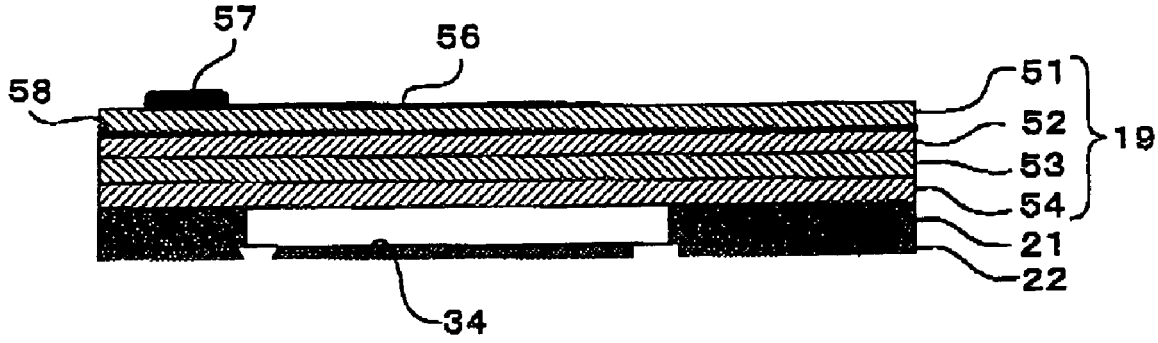
FIG. 10 is a partial sectional view of the actuator unit illustrated in FIG. 6.

FIG. 10 is a sectional view taken along a line X—X in FIG. 9. Referring to FIG. 10, the actuator unit 19 includes four, piezoelectric sheets 51, 52, 53, and 54 having the same thickness of about 15 micrometers. These piezoelectric sheets 51 to 54 are made into a continuous layered flat plate (continuous flat layers) disposed so as to extend over many pressure chambers 34 formed within one ink ejection region in the head main body 2*a*. Since the piezoelectric sheets 51 to 54 are disposed so as to extend over many pressure chambers 34 as the continuous flat layers, the individual electrodes 56 can be arranged on the piezoelectric sheet 51 at a high density by using, e.g., a screen printing technique. Therefore, the pressure chambers 34, formed at positions corresponding to the individual electrodes 56, can also be arranged in a high density so that a high-resolution image can be printed. Each of the piezoelectric sheets 51 to 54 is made of a lead zirconate titanate (PZT)-base ceramic material having ferroelectricity.

As illustrated in FIG. 9, the main electrode region 56*a* of the individual electrode 56 formed on the uppermost piezoelectric sheet 51 has a generally rhombic shape in a plan view similar to that of the pressure chamber 34. A lower acute portion of the generally rhombic main electrode region 56*a* extends out to lead to the auxiliary electrode region 56*b* corresponding to the outside of the pressure chamber 34. A circular land portion 57 electrically connected with the individual electrode 56 is provided at an end of the auxiliary electrode region 56*b*. Referring to FIG. 10, the land portion 57 corresponds to a region in the cavity plate 21 having no pressure chamber 34 formed. The land portion 57 is made of, e.g., gold including glass frits and bonded onto a surface of the extending-out portion in the auxiliary electrode region 56*b*, as illustrated in FIG. 9. The land portion 57 is electrically bonded to a contact formed in the FPC 4, while an illustration of the FPC 4 is omitted in FIG. 10. When bonding the land portion 57 to the FPC 4, the contact of the FPC 4 need be pressed onto the land portion 57. Since the pressure chamber 34 is not formed in the region in the cavity plate 21 corresponding to the land portion 57, sufficient pressing can be performed, thus to obtain a reliable bonding.

A common electrode 58 having the same shape as that of the piezoelectric sheet 51 and a thickness of about 2 micrometers is interposed between the uppermost piezoelectric sheet 51 and the piezoelectric sheet 52 disposed under the piezoelectric sheet 51. Both the individual electrodes 56 and the common electrode 58 are made of, e.g., an Ag—Pd-base metallic material.

The common electrode 58 is grounded in a not-illustrated region. Thus, the common electrode 58 is kept at the ground potential equally at regions corresponding to all the pressure chambers 34. Each individual electrode 56 corresponding to each pressure chamber 34 is connected to a driver IC (not illustrated) through the land portion 57 and the FPC 4 including leads each independently corresponding to one of the individual electrodes 56 so that a potential of one individual electrode 56 can be controlled independently of another.

Subsequently, driving methods of the actuator unit 19 will be described. In the actuator unit 19, the piezoelectric sheet 51 is to be polarized in its thickness direction. That is, the actuator unit 19 has a so-called unimorph structure in which an upper (i.e., distant from the pressure chamber 34) piezoelectric sheet 51 is a layer including active layers and the lower (i.e., near the pressure chamber 34) three piezoelectric sheets 52 to 54 are inactive layers. When the individual electrode 56 is set at a positive or negative predetermined potential, therefore, portions of the piezoelectric sheet 51 applied with an electric field, as sandwiched between the electrodes, act as active layers (pressure generating parts) to contract perpendicularly to a-polarization by a transversal piezoelectric effect, if, for example, the electric Field and the polarization are in the same direction.

In this embodiment, portions of the piezoelectric sheet 51 sandwiched between main electrode regions 56*a* and a common electrode 58 are applied with an electric field, and therefore, act as active layers. Accordingly, only the portions of the piezoelectric sheet 51 sandwiched between the main electrode regions 56*a* and the common electrode 58 contract perpendicularly to the polarization by the transversal piezoelectric effect.

On the other hand, because the piezoelectric sheets 52 to 54 are not affected by the electric field, they do not displace by themselves. Thus, a difference in strain perpendicular to the polarization is produced between the upper piezoelectric sheet 51 and the lower piezoelectric sheets 52 to 54. As a result, the piezoelectric sheets 51 to 54 as a whole are ready to deform (i.e., a unimorph deformation) into a convex shape toward the inactive side. At this time, as shown in FIG. 10, a lower face of the piezoelectric sheets 51 to 54 is fixed to an upper face of a partition or a cavity plate 21 defining the pressure chambers, so that the piezoelectric sheets 51 to 54 deform into the convex shape toward the pressure chamber side. Therefore, the volume of the pressure chamber 34 is decreased to raise a pressure of ink so that the ink is ejected from the nozzle 13. Then, when the individual electrode 56 is returned to the same potential as that of the common electrode 58, the piezoelectric sheets 51 to 54 restore their original shape, and the pressure chamber 34 also restores its original volume so that the pressure chamber 34 draws ink from the sub-manifold channel 30*a*.

In another driving method, all individual electrodes 56 are set in advance at a potential different from that of the common electrode 58. When an ejection request is issued, a corresponding individual electrode 56 is set at the same potential as that of the common electrode 58. Then, at a predetermined timing, the individual electrodes 56 may also be set again at the potential different from that of the common electrode 58. In this case, at a timing when the individual electrode 56 is set at the same potential as that of the common electrode 58, the piezoelectric sheets 51 to 54 return to their original shapes. The corresponding pressure chamber 34 is thereby increased in volume from its initial state (in which potentials of both electrodes are different from each other), such that ink is drawn from the sub-manifold channel 30*a* into the pressure chamber 34. Subsequently, at a timing when the individual electrode 56 is set again at the potential different from that of the common electrode 58, the piezoelectric sheets 51 to 54 deform into a convex shape toward the pressure chamber 34. The volume of the pressure chamber 34 is thereby decreased, and a pressure of ink in the pressure chamber 34 is raised to eject the ink.

Referring again to FIG. 7, a band region R will here be discussed that has a width corresponding to 37.5 dpi (678.0 micrometers) in the arrangement direction A and extends in the arrangement direction B. In this band region R, any of sixteen pressure chamber rows 38*a* to 38*d* includes only one nozzle 13. That is, when such a band region R is defined at an optional position in an ink ejection region corresponding to one actuator unit 19, sixteen nozzles 13 are always distributed in this band region R. Positions of points respectively obtained by projecting these sixteen nozzles 13 onto a straight line extending in the arrangement direction A are distant from each other by a distance corresponding to 600 dpi as a resolution upon printing.

When the sixteen nozzles 13 included in one band region R are denoted by (1) to (16) in order from one whose projected image onto a straight line extending in the arrangement direction A is the leftmost, the sixteen nozzles 13 are arranged in the order of (1), (9), (5), (13), (2), (10), (6), (14), (3), (11), (7), (15), (4), (12), (8), and (16) from the lower side. In the ink-jet head 1 having this structure, by properly driving the actuator unit 19 in accordance with transfer of a print medium, a character and a figure, etc., having a resolution of 600 dpi can be formed.

By way of example, a case will be described in which a straight line extending in the arrangement direction A is printed at a resolution of 600 dpi. First, a reference example case will be briefly described in which nozzles 13 communicate with the same-side acute portions of pressure chambers 34. In this case, in accordance with transfer of a print medium, ink ejection starts from a nozzle 13 in a lowermost pressure chamber row in FIG. 7. Ink ejection is then shifted upward with selecting a nozzle 13 belonging to an upper neighboring pressure chamber row in order. Ink dots are thereby formed in order in the arrangement direction A while neighboring each other at 600 dpi. Finally, all the ink dots form a straight line extending in the arrangement direction A at a resolution of 600 dpi.

In this embodiment, on the other hand, ink ejection starts from a nozzle 13 in the lowermost pressure chamber row 38*b* in FIG. 7, and ink ejection is then shifted upward with selecting a nozzle 13 communicating with an upper neighboring pressure chamber row in order in accordance with transfer of a print medium. In this embodiment, however, since a positional shift of the nozzle 13 in the arrangement direction A per a pressure chamber row from the lower side to the upper side is not always the same, ink dots formed in order in the arrangement direction A in accordance with transfer of the print medium are not arranged at regular intervals of 600 dpi.

More specifically, as shown in FIG. 7, in accordance with transfer of a print medium, ink is first ejected through a nozzle (1) communicating with the lowermost pressure chamber row 38*b* in FIG. 7 to form a dot row on the print medium at intervals corresponding to 37.5 dpi. Then, as the print medium is transferred and a straight line formation position has reached a position of a nozzle (9) communicating with a second lowermost pressure chamber row 38*a*, ink is ejected through the nozzle (9). A second ink dot is thereby formed at a position shifted from a first formed dot position in the arrangement direction A by a distance of eight times the interval corresponding to 600 dpi.

Next, as the print medium is further transferred and the straight line formation position has reached a position of a nozzle (5) communicating with a third lowermost pressure chamber row 38*d*, ink is ejected through the nozzle (5). A third ink dot is thereby formed at a position shifted from the first formed dot position in the arrangement direction A by a distance of four times the interval corresponding to 600 dpi. As the print medium is further transferred and the straight line formation position has reached a position of a nozzle (13) communicating with a fourth lowermost pressure chamber row 38*c*, ink is ejected through the nozzle (13). A fourth ink dot is thereby formed at a position shifted from the first formed dot position in the arrangement direction A by a distance of twelve times the interval corresponding to 600 dpi. As the print medium is further transferred and the straight line formation position has reached a position of a nozzle (2) communicating with a fifth lowermost pressure chamber row 38*b*, ink is ejected through the nozzle (2). A fifth ink dot is thereby formed at a position shifted from the first formed dot position in the arrangement direction A by a distance corresponding to 600 dpi.

Afterwards, in the same manner, ink dots are formed with selecting nozzles 13 communicating with pressure chambers 34 in order from the lower side to the upper side in FIG. 7. In this case, when the number of a nozzle 13 in FIG. 7 is N, an ink dot is formed at a position shifted from the first formed dot position in the arrangement direction A by a distance corresponding to (magnification n=N−1)×(interval corresponding to 600 dpi). When the sixteen nozzles 13 have been finally selected, a gap between the ink dots formed by the nozzles (1) in the lowermost pressure chamber rows 38*b* in FIG. 7 at an interval corresponding to 37.5 dpi is filled up with fifteen dots formed at intervals corresponding to 600 dpi. Thus, as the whole, a straight line extending in the arrangement direction A can be drawn at a resolution of 600 dpi.

At vicinities of both ends of each ink ejection region in the arrangement direction A (oblique sides of the actuator unit 19), a printing at a resolution of 600 dpi can be performed by making a compensation relation to vicinities of both ends, in the arrangement direction A, of another ink ejection region corresponding to an opposite actuator unit 19 in the width of the head main body 2*a*.

Figure 11:
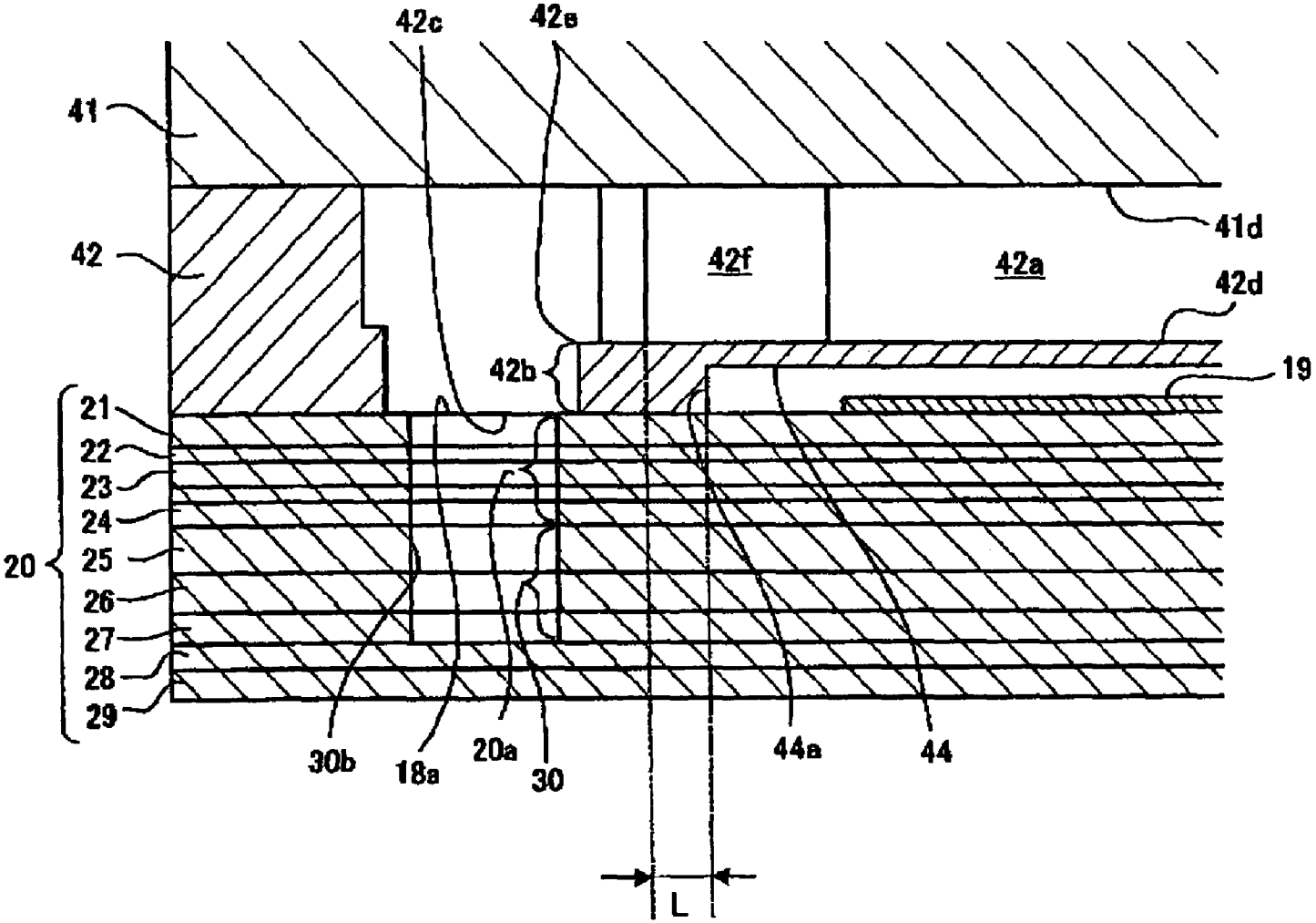
FIG. 11 is a partial enlarged view of FIG. 3.

Next, an ink flow in the ink reservoir 42*a* will further be described. FIG. 11 shows a detailed construction around a connecting passage 42*b* formed in the lower plate 42 of the reservoir unit 40. As illustrated in FIG. 11, the connecting passage 42*b* is a cylindrical passage connecting an outlet port 42*e* of the ink reservoir 42*a* formed on a bottom face 42*d* of the ink reservoir 42*a*, with a connecting port 42*c* formed on a bottom face 44 of the reservoir unit 40. On sidewalls of the ink reservoir 42*a*, semicylindrical notches are formed at portions corresponding to each connecting passage 42*b* so that the ink reservoir 42*a* and the connecting passages 42*b* may communicate with each other.

Referring to FIGS. 4 and 11, four pillars 42*f* are formed in the ink reservoir 42*a*. The four pillars 42*f* connect a bottom face 41*d* of the upper plate 41 with the bottom face 42*d* of the ink reservoir 42*a*. Each pillar 42*f*, formed as a part of the lower plate 42, protrudes from the bottom face 42*d* of the ink reservoir 42*a* by such a height as to be in contact with the bottom face 41*d* of the upper plate 41. The pillar 42*f* has an elliptic section elongated in the longitudinal direction of the ink reservoir 42*a*. As described above, ink supplied from the inlet port 41*c* into the ink reservoir 42*a* flows in the ink reservoir 42*a* toward the other end in the longitudinal direction of the ink reservoir 42*a*. Accordingly, the ink introduced from the inlet port 41*c* into the ink reservoir 42*a* can smoothly flow in the ink reservoir 42*a* without being interrupted by the pillars 42*f*. Therefore, ink can smoothly flow into connecting passages 42*b* relatively distant from the supply passage 41*a*.

Figure 12:
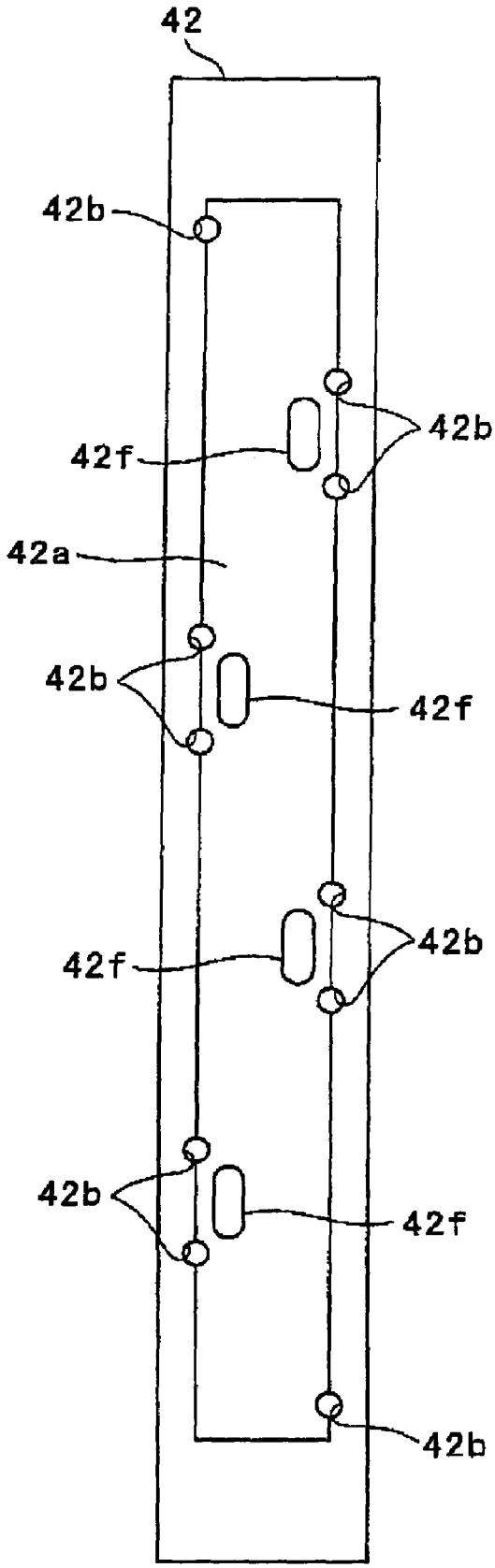
FIG. 12 is a plan view of the reservoir unit illustrated in FIG. 5.

As illustrated in FIG. 12, the four pillars 42*f* are arranged in two lines in the ink reservoir 42*a*, with each line including two pillars 42*f*, along the longitudinal direction of the ink reservoir 42*a*. Since each pillar 42*f* is disposed at a position corresponding to an upper side of parallel opposed sides of each actuator unit 19, the pillars 42*f* form a zigzag pattern. As illustrated in FIGS. 5 and 11, each pillar 42*f* is positioned near the outlet port 42*e* leading to the connecting passage 42*b* such that a part of the pillar 42*f* may overlap with the protruding area 44*a* in a direction along the bottom face 44 of the reservoir unit 40, with an overlapping length L.

Referring to FIG. 11, ink flown from the outlet port 42*e* of the ink reservoir 42*a* into the connecting passage 42*b* vertically flows down to go through the connecting port 18*a* formed on the surface of the passage unit 20 into the connecting passage 20*a* formed in the passage unit 20, and then vertically flows down. The ink subsequently goes from inlet port 30*b* into the manifold channel 30 formed continuously from the connecting passages 20*a*. The ink introduced into the manifold channel 30 flows through the sub-manifold channel 30*a* into each individual ink passage, and is ejected from nozzles 13 at an appropriate timing.

The head main body 2*a* is manufactured by positioning and bonding, with an adhesive or by metal bonding, three units laminated independently of one another, i.e., the reservoir unit 40, the passage unit 20, and the actuator units 19. Metal bonding is a bonding method in which a bonding is obtained by pressurizing and heating two metallic materials, so that a part of their constituent elements is mutually diffused at a contact portion between the two materials, and then a bonding region gradually spreads with time elapse. When, for example, the contact portion is a mirror plane, a bonding over a whole surface may be performed using metal bonding. Since the reservoir unit 40 is formed therein with the wide ink reservoir 42*a* along the longitudinal direction thereof, if no pillars 42*f* are formed in the ink reservoir 42*a*, most of a pressure applied to the upper plate 41 of the reservoir unit 40 during a bonding process of the reservoir unit 40 and the passage unit 20, serves to bend the upper plate 41 toward the lower plate 42. As a result, a pressure between the reservoir unit 40 and the passage unit 20 becomes insufficient, which may cause an ink leakage from an interface therebetween.

In this embodiment, however, since the ink reservoir 42*a* is formed therein with the pillars 42*f* connected to upper and lower walls 41*d* and 42*d*, respectively, of the ink reservoir 42*a*, a pressure applied to the upper plate 41 of the reservoir unit 40 during a bonding process of the reservoir unit 40 and the passage unit 20 hardly serves to bend the upper plate 41 toward the lower plate 42. That is, most of the pressure applied to the upper plate 41 for bonding is given, via the pillars 42*f*, to a bonding surface between the reservoir unit 40 and the passage unit 20. In addition, irregularities in the pressure applied to the bonding surface is decreased. As a result, the reservoir unit 40 and the passage unit 20 are bonded to each other with a sufficient pressure, thereby preventing an ink leakage from an interface therebetween.

In this embodiment, in particular, since a part of the pillar 42*f* overlaps with the protruding area 44*a* in the direction along the bottom face 44, a force transmitted from the upper plate 41 to the pillar 42*f* hardly serves to bend downward the bottom face 42*d* of the ink reservoir 42*a*, and therefore, a larger pressure can be applied to the bonding surface between the reservoir unit 40 and the passage unit 20. The pressure is enhanced with an increase of the length L that indicates an extent of overlapping. The pillar 42*f* and the protruding area 44*a* need be enlarged in order to increase the length L. However, an excessive enlargement of the pillar 42*f* may interrupt flow of ink in the ink reservoir 42*a*, and an excessive enlargement of the protruding area 44*a* may fail to secure a sufficient region for bonding the actuator unit 19. Therefore, it is preferable to appropriately determine the length L in view of their balance.

In a modification, the pillar 42*f* may be positioned so as not to overlap with the protruding area 44*a* in the direction along the bottom face 44. In this case, a rubber support for covering the actuator unit 19 is preferably disposed on the passage unit 20 during a bonding process in order to prevent a force transmitted from the upper plate 41 to the pillar 42*f* from serving to bend downward the bottom face 42*d* of the ink reservoir 42*a*. The support has nearly the same thickness as a height of the protruding area 44*a* so that it may connect the lower face 44 in the recessed area of the reservoir unit 40 with the upper face of the passage unit 20. In this way, even when the pillar 42*f* and the protruding area 44*a* do not overlap with each other in the direction along the bottom face 44, a force transmitted from the upper plate 41 to the pillar 42*f* does not serve to bend downward the bottom face 42*d* of the ink reservoir 42*a*, thereby applying a larger pressure to the bonding surface between the reservoir unit 40 and the passage unit 20. The support may advantageously be used when the pillar 42*f* and the protruding area 44*a* overlap with each other in one part and do not in another part.

As described above, the semicylindrical notches are formed at portions of the sidewalls of the ink reservoir 42*a* corresponding to each connecting passage 42*b* so that the ink reservoir 42*a* and the connecting passages 42*b* may communicate with each other. Accordingly, if no pillars 42*f* are formed, a force applied from the upper plate 41 is not sufficiently transmitted in vicinities of the connecting passages 42*b* to the bonding surface between the reservoir unit 40 and the passage unit 20, to cause a variation in pressure around the connecting passages 42*b*. In this embodiment, the pillars 42*f* are formed in the vicinities of the outlet ports 42*e* each leading to the connecting passage 42*b*, and therefore, a variation in pressure around the connecting passages 42*b* can be suppressed.

In this embodiment, moreover, the four pillars 42*f* are arranged in a zigzag manner in the longitudinal direction of the ink reservoir 42*a*. Consequently, most of a pressure applied to the upper plate 41 can be given, through the pillars 42*f*, to the bonding surface between the reservoir unit 40 and the passage unit 20 at any spot in the ink reservoir 42*a*, without increasing the pillar 42*f* in number or excessively enlarging a size of one pillar 42*f*. Therefore, irregularities in pressure for bonding the reservoir unit 40 and the passage unit 20 depending on a place can be lessened.

In this embodiment, further, since the reservoir unit 40 is formed by laminating the two plates 41 and 42 defining the ink reservoir 42*a* together, a manufacture of the structure is relatively easy, in which the ink reservoir 42*a* is formed therein the pillars 42*f* connecting the upper and lower walls 41*d* and 42*d* of the ink reservoir 42*a*.

Figure 13:
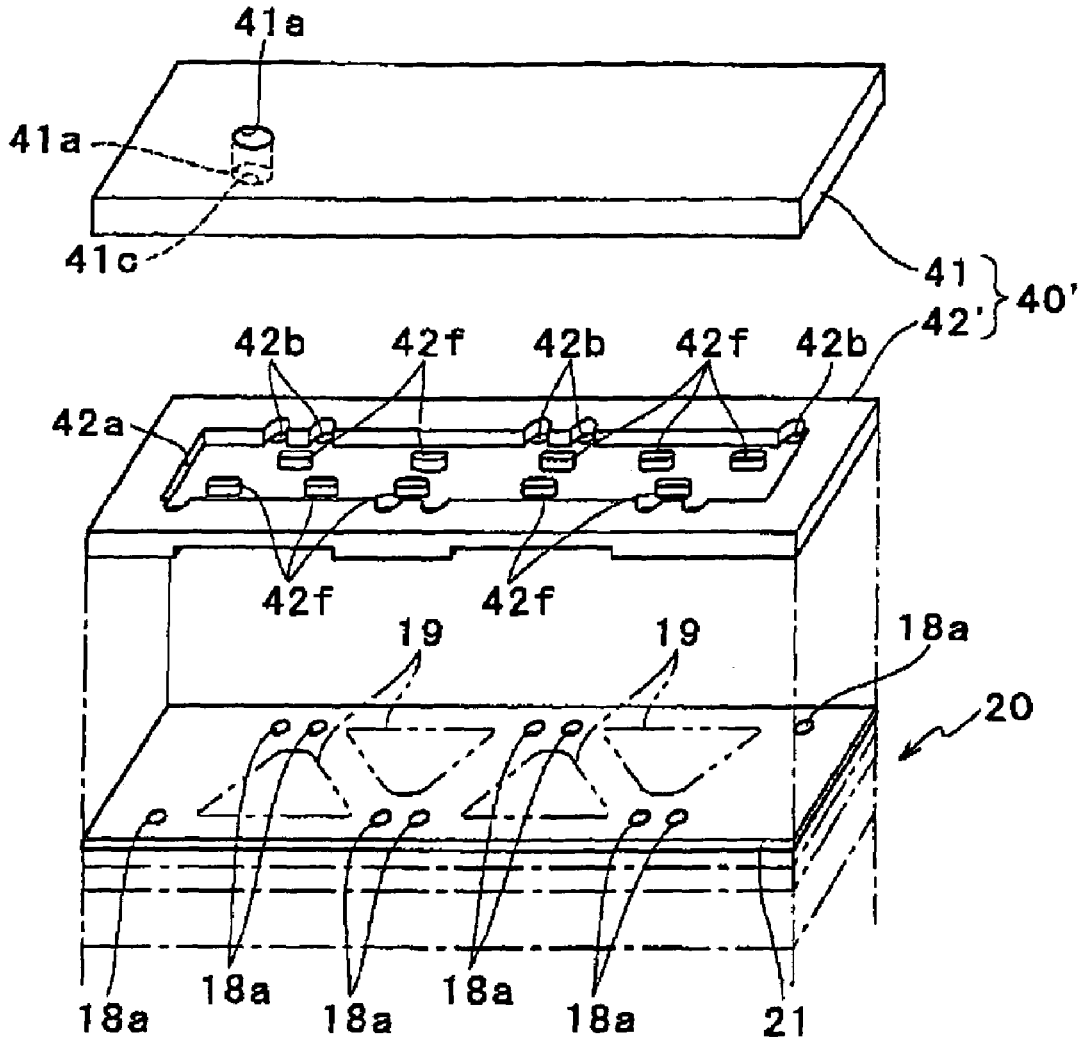
FIG. 13 is an exploded perspective view of a head main body included in an ink-jet head according to a second embodiment of the present invention.
Figure 14:
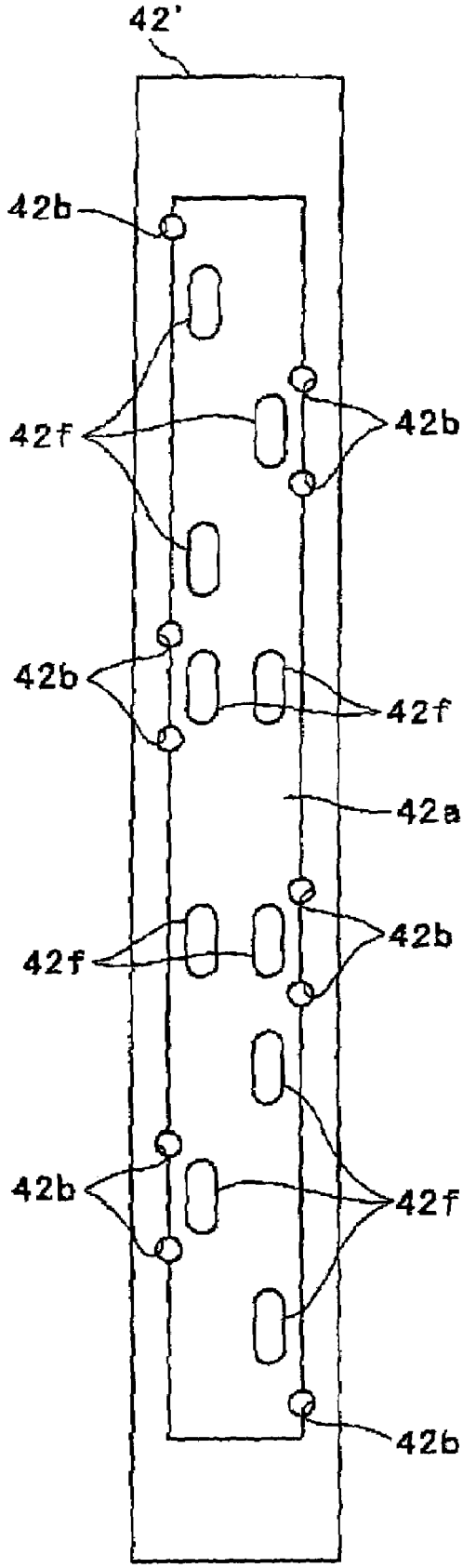
FIG. 14 is a plan view of a reservoir unit included in the head main body illustrated in FIG. 13.

Next, a second embodiment of the present invention will be described. Here in this embodiment, the same members as in the first embodiment will be indicated by the common reference numerals and will not be described. Referring to FIGS. 13 and 14, in this embodiment, ten pillars 42*f* are formed in an ink reservoir 42*a* within a reservoir unit 40' formed by a lamination of an upper plate 41 and a lower plate 42'. These ten pillars 42*f* is, as illustrated in FIG. 14, arranged in two lines in the ink reservoir 42*a*, with each line including five pillars 42*f*, along the longitudinal direction of the ink reservoir 42*a*. The five pillars 42*f* in each line are arranged at almost the same intervals.

Each of the ten pillars has an elliptic section elongated in a longitudinal direction of the ink reservoir 42*a*. Six pillars 42*f* added to the four pillars 42*f* in the first embodiment are disposed near outlet ports 42*e* leading to connecting passages 42*b*. However, the six pillars 42*f* are, differently from the four pillars 42*f*, positioned so as not to overlap with protruding areas 44*a* in a direction along a bottom face 44 of the reservoir unit 40.

In this embodiment, since the pillars 42*f* in the ink reservoir 42*a* are thus increased in number, a contact area of the pillars 42*f* with the upper plate 41 is increased to enhance the effect of increasing a pressure described above. Accordingly, an ink leakage from a bonding surface can more effectively be prevented.

In the aforementioned embodiments, the sectional shape of the pillar may be changed to any optional shape, and may be, for example, circular or rectangular, and the like. In terms of smooth ink flow, however, an elongated shape elongated in the longitudinal direction of the ink reservoir is preferable. The number or the position of the pillar may also be properly changed. A pressure between the reservoir unit and the passage unit increases as the pillars increase in number or as a sectional area of one pillar is enlarged. The position of the pillar may also be changed. Although, in the above embodiments, the pillar is disposed near the outlet port 42*e* leading to the connecting passage 42*b*, this is not limitative. Although, in the above embodiments, the pillar connects two opposite walls extending perpendicularly to a direction perpendicular to the bonding surface, the above-described effects may be obtained when the pillar connects two opposite walls extending along the bonding surface. Moreover, in the above embodiments, the pillars formed as a part of the lower plate 42 may be bonded with an adhesive to the bottom face 41*d* of the upper plate 41.

The connecting passage and the supply passage may be arbitrarily changed in number. For example, two or more connecting passages may be formed, and the number of the supply passage may be increased or decreased in accordance with a length of the head. Moreover, although, in the above embodiments, the lower plate 42 of the reservoir unit 40 is applied with a half etching capable of a processing with high accuracy, other processing methods such as laser machining, instead of the half etching, may be performed to form protruding areas or recessed areas on the upper and lower faces of the lower plate 42. Further, the lower plate 42 of the reservoir unit 40 may be formed of two plates, or of three or more plates.

Although the above embodiments illustrate that the reservoir unit is bonded to the passage unit formed with the nozzles, it may not necessarily be the reservoir unit that is to be bonded to the passage unit. For example, a unit formed with passages for connecting the passage unit and the reservoir unit may be used. Further, although, in the above embodiments, the manifold channel acting as a common ink chamber is provided in the passage unit, the common ink chamber may be provided outside the passage unit.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head comprising:

a passage unit formed with a plurality of nozzles for ejecting ink, and including a plurality of individual ink passages each leading via a pressure chamber to the nozzle, and a reservoir unit bonded to the passage unit by being pressurized, including an ink reservoir extending along a bonding surface between the reservoir unit and the passage unit, to reserve ink supplied from an ink tank and supply the reserved ink to the passage unit, wherein the ink reservoir is formed therein with one or more pillars supporting two opposite walls of the ink reservoir both extending perpendicularly to a direction across the bonding surface between the reservoir unit and the passage unit.

2. The ink-jet head according to claim 1, wherein the ink reservoir has an elongated shape elongated in one direction along the bonding surface, and a cross section of the pillar has an elongated shape elongated in the one direction.

3. The ink-jet head according to claim 1, wherein, in the ink reservoir, the pillar is disposed near an outlet port of the ink reservoir.

4. The ink-jet head according to claim 1, wherein the bonding surface of the reservoir unit has a protruding area bonded to the passage unit, and a recessed area with a protruding amount thereof toward the passage unit being smaller than that of the protruding area, and wherein an actuator unit for applying an ejection energy to ink in the pressure chamber is bonded to a region on a surface of the passage unit facing the recessed area.

5. The ink-jet head according to claim 4, wherein at least a part of the pillar overlaps with the protruding area with respect to a direction along the bonding surface.

6. The ink-jet head according to claim 5, wherein the ink reservoir has an elongated shape elongated in one direction along the bonding surface, and a plurality of pillars are arranged in a zigzag manner with respect to the one direction.

7. The ink-jet head according to claim 1, wherein the reservoir unit is constituted by a plurality of plates laminated in a direction across the bonding surface.

8. An ink-jet head comprising:

a first passage unit formed with a plurality of nozzles for ejecting ink, and a second passage unit bonded to the first passage unit by being pressurized, wherein the first passage unit includes a plurality of individual ink passages each leading via a pressure chamber to the nozzle, wherein the second passage unit includes a common ink passage through which ink to be supplied to the individual ink passages passes, and wherein the common ink passage is formed therein with one or more pillars supporting two opposite walls of the common ink passage both extending perpendicularly to a direction across a bonding surface between the second passage unit and the first passage unit.

9. An ink-jet head comprising:

a passage unit formed with a plurality of nozzles for ejecting ink, a reservoir unit bonded to the passage unit, by being pressurized, at a plurality of protruding areas thereof, and having an elongated shape elongated in one direction along a bonding surface between the reservoir unit and the passage unit, and a plurality of actuator units for applying an ejection energy to ink in the passage unit, bonded to the passage unit in a zigzag pattern with respect to the one direction, wherein the passage unit includes:

a common ink chamber, a plurality of first connecting passages each connecting an inlet port of the common ink chamber with a first connecting port formed on a surface of the passage unit, and a plurality of individual ink passages each extending from an outlet port of the common ink chamber through a pressure chamber to the nozzle;

wherein the reservoir unit includes:

an ink reservoir extending along the bonding surface to have an elongated shape elongated in the one direction, a supply passage connecting an inlet port of the ink reservoir with a supply port formed an a surface of the reservoir unit, and a plurality of second connecting passages each connecting an outlet port of the ink reservoir with a second connecting port formed on the surface of the reservoir unit, each of the second connecting passages being connected to the corresponding first connecting passage so as to communicate the ink reservoir with the common ink chamber;

wherein the ink reservoir is formed therein a plurality of pillars having a cross sectional shape elongated in the one direction and supporting two opposite walls of the ink reservoir both extending perpendicularly to a direction across the bonding surface between the reservoir unit and the passage unit; and wherein at least one of the pillars is formed with respect to each protruding area, and at least a part of the pillar overlaps with the corresponding protruding area with respect to a direction along the bonding surface.

10. The ink-jet head according to claim 9, wherein the reservoir unit is constituted by a first plate formed with the supply passage, and a second plate formed with the second connecting passages and laminated with the first plate to define the ink reservoir with the first plate.

* * * * *